US006427983B1

(12) United States Patent
Leonhardt et al.

(10) Patent No.: US 6,427,983 B1
(45) Date of Patent: Aug. 6, 2002

(54) SELF-RESTORING HIGHWAY CRASH ATTENUATOR

(75) Inventors: Patrick A. Leonhardt, Rocklin; James B. Welch, Placerville, both of CA (US)

(73) Assignee: Energy Absorption Systems, Inc., Chicago, IL (US)

( * ) Notice: Subject to any disclaimer, the term of this patent is extended or adjusted under 35 U.S.C. 154(b) by 0 days.

(21) Appl. No.: 09/689,382

(22) Filed: Oct. 12, 2000

(51) Int. Cl.[7] ..... A01K 3/00
(52) U.S. Cl. ..... 256/13.1; 404/6; 256/1
(58) Field of Search ..... 256/13.1, 1; 404/6, 404/9, 10

(56) References Cited

U.S. PATENT DOCUMENTS

| | | | | |
|---|---|---|---|---|
| 3,503,600 A | * | 3/1970 | Rich | 256/1 |
| 3,674,115 A | * | 7/1972 | Young et al. | 404/6 |
| 3,680,662 A | * | 8/1972 | Walker et al. | 188/377 |
| 3,845,936 A | * | 11/1974 | Boedecker, Jr. et al. | 256/1 |
| 3,880,404 A | * | 4/1975 | Fitch | 256/1 |
| 4,399,980 A | | 8/1983 | van Schie | |
| 4,452,431 A | * | 6/1984 | Stephens et al. | 256/13.1 |
| 4,645,375 A | | 2/1987 | Carney, IIII | |
| 5,125,762 A | * | 6/1992 | Strassil | 404/6 |
| 5,314,261 A | | 5/1994 | Stephens | |
| 5,403,122 A | | 4/1995 | Carney, III | |
| 5,480,255 A | | 1/1996 | Bernquez et al. | |
| 5,568,913 A | | 10/1996 | Nagler | |
| 5,607,252 A | | 3/1997 | Tischer | |
| 6,126,144 A | * | 10/2000 | Hirsch et al. | 256/13.1 |

FOREIGN PATENT DOCUMENTS

| | | |
|---|---|---|
| DE | 31 06 694 A1 | 9/1982 |
| DE | 38 09 470 A1 | 10/1989 |
| FR | 2 691 124 A1 | 5/1992 |

OTHER PUBLICATIONS

European Search Report for Application No. EP 01 30 8440 dated Jan. 2002.

* cited by examiner

*Primary Examiner*—Lynne H. Browne
*Assistant Examiner*—John Cottingham
(74) *Attorney, Agent, or Firm*—Brinks Hofer Gilson & Lione

(57) ABSTRACT

A highway crash attenuator includes an array of resilient self-restoring polymeric tubes. Adjacent tubes are secured together by threaded fasteners, and the tubes of the rear row of the array are secured to a rigid object by threaded fasteners. The tubes form a rectangular array, without cables, frameworks or panels between the exterior surfaces of the array and oncoming traffic. The tubes of the front row of the array are provided with a greater wall thickness than the remaining tubes of the array to increase the mass and stiffness of the front of the array.

11 Claims, 4 Drawing Sheets

SELF-RESTORING HIGHWAY CRASH ATTENUATOR

BACKGROUND

This invention relates to crash attenuators intended to be placed alongside a roadway to protect the occupants of a vehicle that has left the roadway, and in particular to a self-restoring highway crash attenuator.

Carney U.S. Pat. No. 4,645,375 discloses a stationary impact attenuation system comprising a triangular array of vertically oriented metal cylinders mounted in front of a rigid object. An impacting vehicle deforms these metal cylinders, thereby reducing the maximum acceleration to which vehicle occupants are exposed. Since it uses metal tubes, the disclosed attenuation system is not self-restoring, and substantial replacement or refurbishment is required after each impact to restore the attenuation system to its original condition.

Tischer U.S. Pat. No. 5,607,252 discloses a highway collision containment system including a triangular array of flexible foam cylinders. The rear row of cylinders is held in place by stakes passing through the longitudinal axes of the cylinders, and the forward cylinders are held to the rearward cylinders by sheaths that are secured around the foam cylinders and to each other.

Stephens U.S. Pat. No. 5,314,261 discloses a vehicle crash cushion including an array of rubber cylinders that are secured together and to a wall. These cylinders are protected from contact with impacting vehicles by an array of panels 12 interposed between the rubber cylinders and the roadway. In the disclosed system, the rubber cylinders control the position of the panels 12, and it is the panels 12 that actually come into contact with an impacting vehicle.

In spite of the work described above, a need presently exists for a restorable crash attenuator that is simple to fabricate and to install, that provides an improved deceleration profile to an impacting vehicle, and that substantially restores itself to its original position after at least some impacts.

SUMMARY

The preferred crash attenuator described below includes an array of resilient, self-restoring, polymeric tubes. Each of these tubes is characterized by a respective longitudinal axis and a respective wall thickness. The array includes at least three rows of tubes, and each row includes at least three tubes. The rows include a back row positioned closest to a rigid object, and a front row positioned farthest from the rigid object. Adjacent ones of the tubes are secured directly to one another, preferably by threaded fasteners, and the tubes of the back row are secured to the rigid object by other fasteners.

The preferred highway crash attenuator described below uses tubes with a substantially greater wall thickness for the front row than for the remaining rows. Also, the preferred crash attenuator uses an equal number of tubes in each of the rows, such that the array is rectangular rather than triangular, and such that the array defines two opposed sides extending between the front and the back row and a front comprising the front row. The tubes themselves form the outermost surfaces of the crash attenuator at the two sides and at the front, and the need for a supporting or protecting framework such as the panels 12 of the Stephens patent is thereby eliminated. Other array shapes and other distributions of wall thickness in the array are possible.

The foregoing paragraphs have been provided by way of general introduction, and they are not intended to limit the scope of the following claims.

DETAILED DESCRIPTION OF THE PRESENTLY PREFERRED EMBODIMENTS

Figure 1:
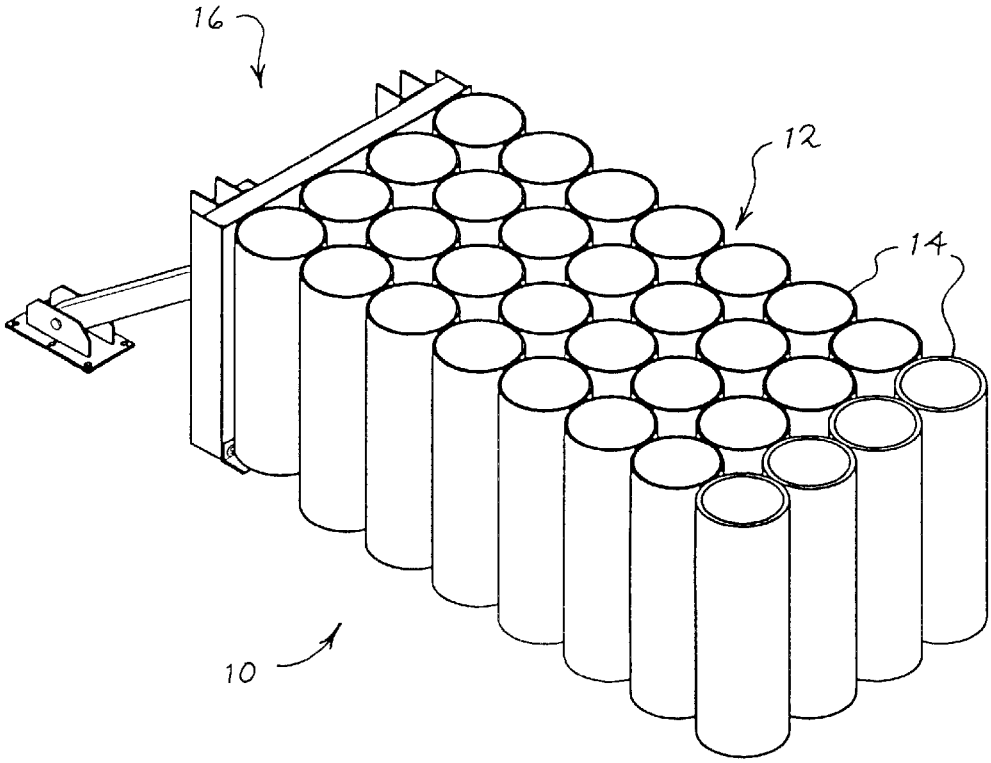
FIG. 1 is a perspective view of a highway crash attenuator that incorporates a preferred embodiment of this invention.
Figure 2:
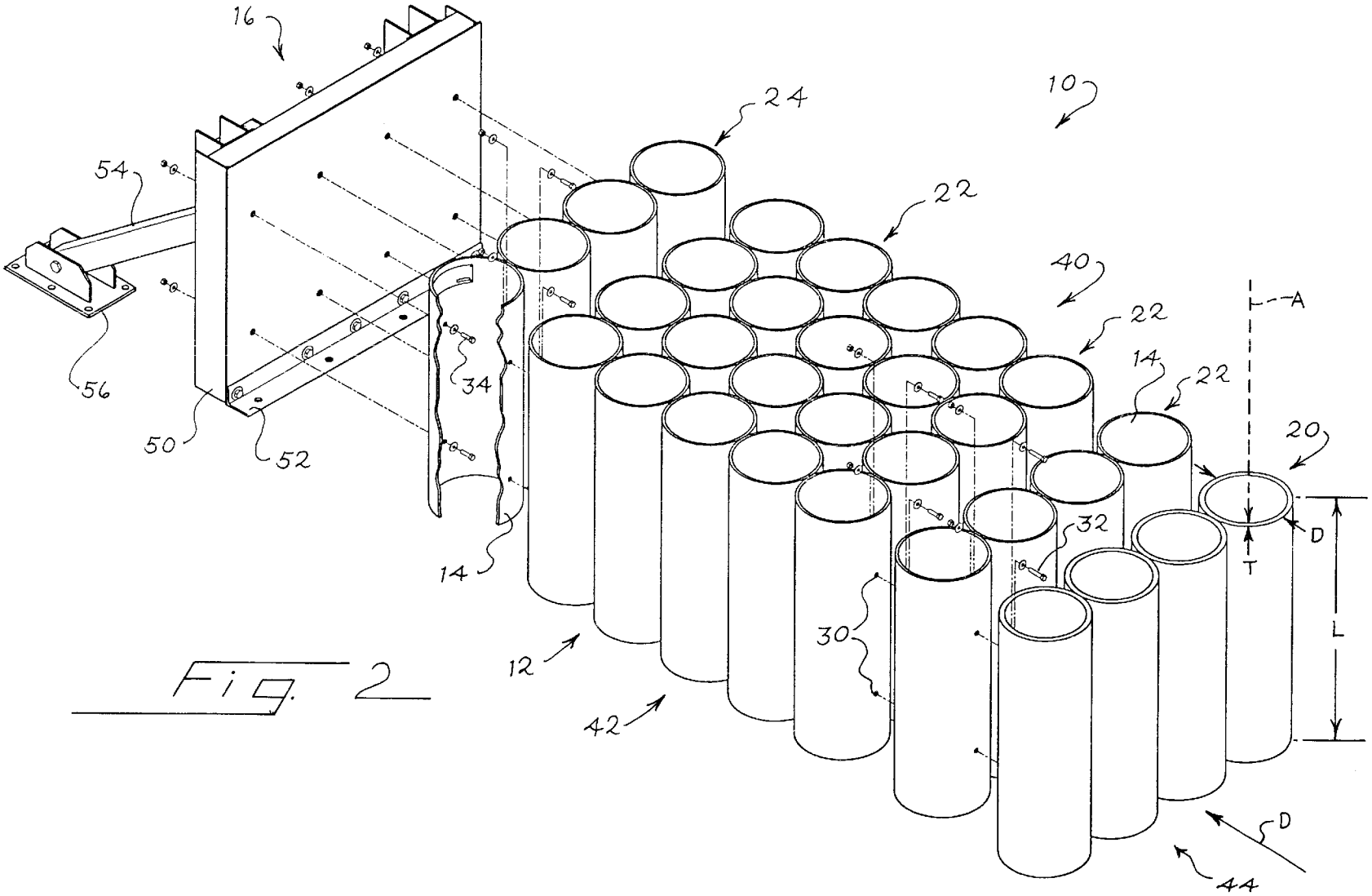
FIG. 2 is an exploded perspective view of the crash attenuator of FIG. 1.

Turning now to the drawings, FIGS. 1 and 2 show perspective views of a crash attenuator 10 that incorporates a preferred embodiment of this invention. The crash attenuator 10 includes an array 12 of resilient, self-restoring, polymeric tubes 14 positioned in front of a rigid object 16. Each of the tubes 14 defines a respective longitudinal axis A, and in this embodiment all of the axes A are oriented parallel to one another and substantially vertical.

As best shown in FIG. 2, the array 12 includes a front row 20, middle rows 22 and a back row 24 of the tubes 14. In this embodiment the array 12 is a rectangular array, and each of the rows 20, 22, 24 includes four of the tubes 14. In general, the array 12 preferably includes at least three rows of the tubes 14, and each row includes at least three tubes 14.

Each of the tubes 14 defines at least four holes 30, and the holes 30 of adjacent tubes 14 are aligned to receive first fasteners 32. Thus, each of the tubes 14 is secured to each adjacent tube 14 by two first fasteners 32. Similarly, each of the tubes 14 of the back row 24 is secured to the rigid object 16 by a pair of second fasteners 34. In this example, the first and second fasteners 32, 34 take the form of threaded fasteners such as ½ inch hex bolts, nuts, and washers (grade 5). Simply by way of example, the washers can have an outer diameter of 1 inch.

Thus, the fasteners 32 secure the tubes 14 to each other to form a self-supporting array that is in turn secured in place only to the rigid object 16, and only by the fasteners 34.

Various materials can be used for the tubes 14. In this example, the tubes 14 are formed from a high density polyethylene, such as the material commonly used for sewer pipe. Each tube defines a length L, an outer diameter D and a thickness T as shown in FIG. 2. Table 1 provides preferred dimensions for the tubes 14. As shown in Table 1, in this example all of the tubes 14 have the same outer diameter, and the tubes of the middle rows 22 and the back row 24 have the same wall thickness. The wall thickness of the tubes of the front row 20 is preferably at least 1.5 times and more preferably at least 1.8 times the wall thickness of the tubes of the rearwardly adjacent row. This provides the advantage of increasing the mass and the stiffness of the tubes of the front row 20, thereby providing increased deceleration at the beginning of an impact event, as described in U.S. Pat. No. 6,092,959, assigned to the assignee of the present invention and hereby incorporated by reference. The lengths of the tubes of the front row 20 and the middle rows 22 are equal, but the length of the tubes of the back row 24 is preferably somewhat less. This is done to create a space beneath the tubes of the back row 24 near the lower portion of the rigid object 16. This facilitates installation of the rigid object 16 as described below.

TABLE 1

| | Preferred Tube Dimensions (cm) | | |
|---|---|---|---|
| | Length L | Outer Diameter D | Wall Thickness T |
| Front Row 20 | 99.1 | 32.4 | 4.1 |
| Middle Rows 22 | 99.1 | 32.4 | 2.2 |
| Back Row 24 | 91.4 | 32.4 | 2.2 |

As shown in FIGS. 1 and 2, in this preferred embodiment there an equal number of the tubes 14 in each of the rows 20, 22, 24, and the array 12 is therefore a rectangular array. This is quite different from triangular arrays of the prior art, because it increases the mass and the stiffness of the array 14 that contacts an impacting vehicle first in the event of a collision in the anticipated impact direction D.

The array 14 defines two opposed sides 40, 42 and a front 44. Note that in this preferred embodiment the sides 40, 42 are defined by outer ones of the tubes 14 and the front 44 is defined by the tubes of the front row 20. Since the tubes 14 form the outermost surfaces of the crash attenuator 10 at the two sides 40, 42 and the front 44, all external bracing, framework, panels, and cables are eliminated. This substantially simplifies installation of the attenuator and eliminates metallic elements that are positioned to engage an impacting vehicle.

Figure 3:
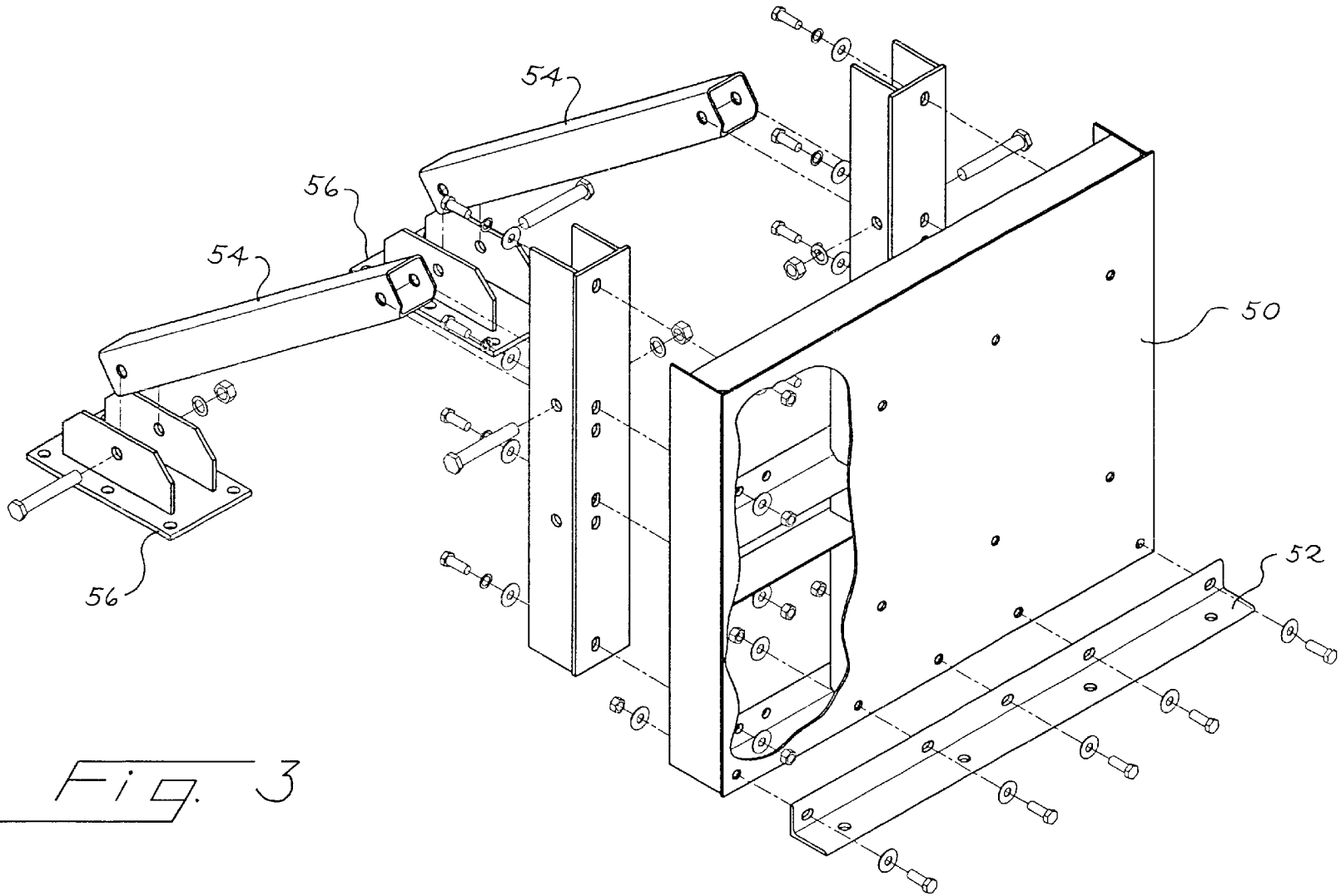
FIG. 3 is an exploded perspective view of the rigid object that is positioned immediately behind the rear row of tubes in the embodiment of FIGS. 1 and 2.

The back row 24 of tubes 14 can be attached to any rigid object from which an impacting vehicle is to be protected. In this example, the rigid object 16 includes a back-up plate 50 as shown in FIG. 3 that includes a lower lip 52. In use, the lower lip 52 is bolted to a concrete pad to secure the lower edge of the back-up plate 50 in place. The upper portion of the back-up plate 50 is supported by two braces 54 that extend downwardly to respective anchors 56. Since the tubes 14 of the back row 24 are shorter than the remaining tubes 14 of the array, a space is left immediately above the lip 52. This facilitates access to the fasteners that secure the lip 52 to the back-up plate 50 and the lip 52 to the concrete apron.

Figure 4:
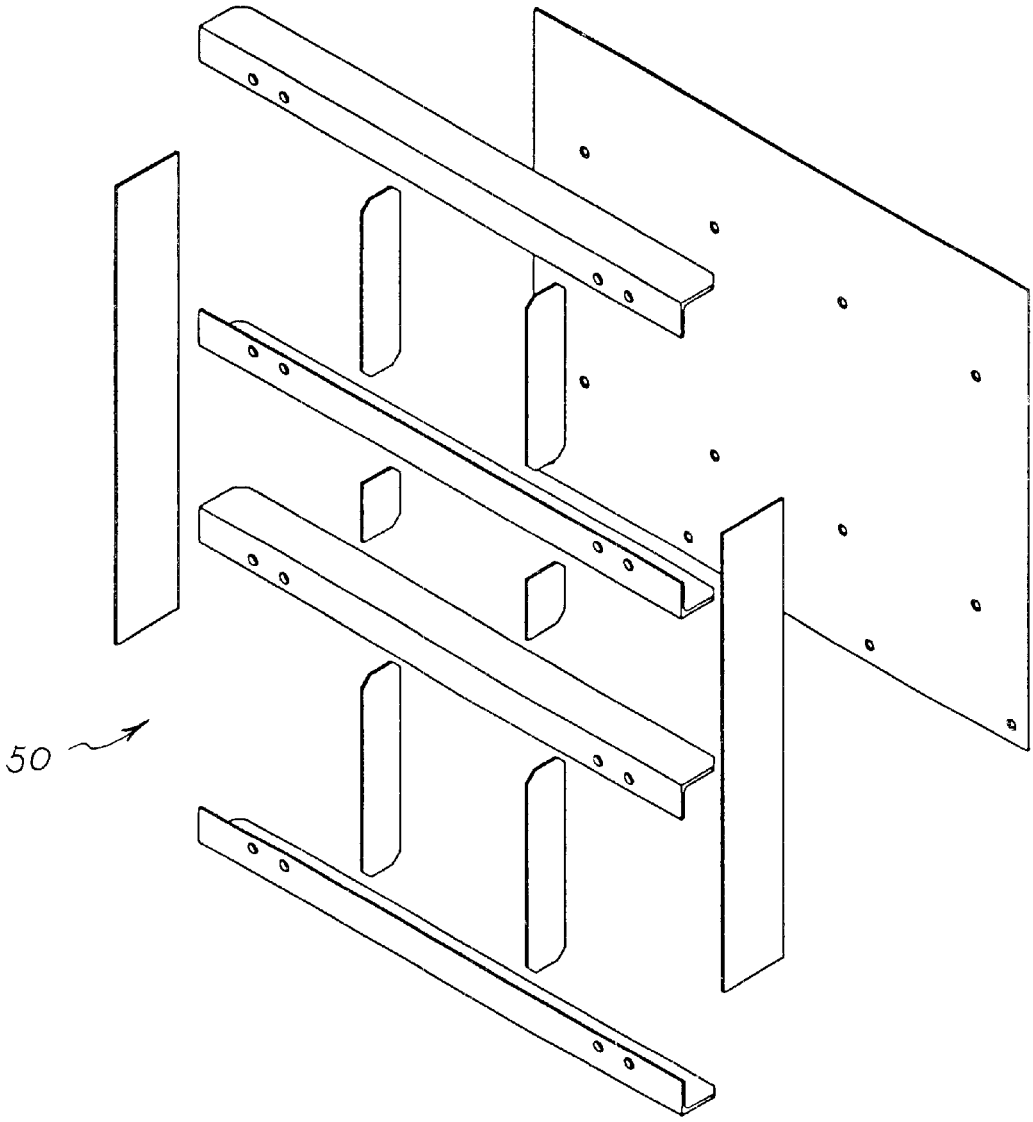
FIG. 4 is an exploded perspective view of the back-up plate included in the rigid object of FIG. 3.

FIG. 4 shows an exploded perspective view from the rear of the back-up plate 50, including the internal braces.

In alternative embodiments, the back row 24 of tubes 14 can be bolted directly to a concrete bridge pier for example, and the back-up plate 50, braces 54 and anchors 56 can be eliminated.

The crash attenuator 10 provides the important advantage that it is quick and easy to install, thereby subjecting installing personnel to the dangers of oncoming traffic for a relatively short time. Since the tubes 14 are self-restoring, the crash attenuator 10 is relatively low in maintenance requirements, and can often be re-used without any maintenance after an impact. As used herein, the term "self-restoring" is intended broadly to signify that the energy-absorbing elements of the crash barrier return to at least 80 percent of the original dimensions after a typical impact, and it should be understood that a self-restoring energy-absorbing element may not self-restore to precisely its original dimensions.

Of course, many changes and modifications can be made to the preferred embodiment described above. Other materials such as various rubbers and/or polymers can be used for the tubes 14, and the tubes 14 may be arranged and shaped in other sizes and proportions. For example, the array can be longer and wider than that shown. As other alternatives, the array may have a different number of tubes in various ones of the rows. For example, the array may taper from a narrower front (fewer tubes per row) to a wider center section or rear section (more tubes per row). Also, tube diameter may vary within the array, and wall thickness of the tubes may vary within the array in other ways than that listed in Table 1. For example, the tubes of the rear row may have a greater thickness than the tubes of the middle rows, and the tubes may vary in wall thickness within a row.

Though various features of the preferred embodiment described above are preferably used together, it should be understood that many of the features described above can be used separately.

The foregoing detailed description has discussed only a few of the many forms that this invention can take. For this reason, this detailed description is intended by way of illustration and not limitation. It is only the following claims, including all equivalents, that are intended to define the scope of this invention.

What is claimed is:

1. A highway crash attenuator comprising:

an array of resilient, self-restoring, tubes comprising a material selected from the group consisting of polymers, elastomers, and combinations thereof, each said tube characterized by a respective longitudinal axis and a respective wall thickness, the array comprising at least three rows of said tubes, each row comprising at least three of said tubes, said rows comprising a front row and a back row, said back row positioned closest to a rigid object, said front row positioned farthest from the rigid object;

adjacent ones of said tubes secured to one another by a plurality of first fasteners;

the tubes of said back row secured to the rigid object by a plurality of second fasteners;

the wall thickness of the tubes of the front row being greater than the wall thickness of the tubes of the remaining rows;

the longitudinal axes of the tubes oriented substantially vertically.

2. A highway crash attenuator comprising:

an array of resilient, self-restoring, tubes comprising a material selected from the group consisting of polymers, elastomers, and combinations thereof, each said tube characterized by a respective longitudinal axis and a respective wall thickness, the array comprising at least three rows of said tubes, each row comprising at least three of said tubes, said rows comprising a front row and a back row, said back row positioned closest to a rigid object, said front row positioned farthest from the rigid object;

adjacent ones of said tubes secured to one another by a plurality of first fasteners;

the tubes of said back row secured to the rigid object by a plurality of second fasteners;

the wall thickness of the tubes of the front row being at least 1.5 times greater than the wall thickness of the tubes of the row rearwardly adjacent the front row;

the longitudinal axes of the tubes oriented substantially vertically.

3. The invention of claim 1 or 2 wherein each said tube comprises high density polyethylene.

4. The invention of claim 1 or 2 wherein each said tube is further characterized by a respective length, and wherein the length of the tubes of the back row is less than the length of the tubes of the remaining rows.

5. The invention of claim 1 or 2 wherein each said tube is characterized by a respective diameter, and wherein the diameter of the tubes of the front row is no less than the smallest diameter of the tubes of the remaining rows.

6. The invention of claim 1 or 2 wherein each said tube is characterized by a respective outer diameter, and wherein the outer diameters of all of the tubes of the array are substantially identical.

7. The invention of claim 1 or 2 wherein the wall thickness of the tubes of the front row is at least 1.5 times the wall thickness of the tubes of the remaining rows.

8. The invention of claim 1 or 2 wherein said array comprises two opposed sides extending between the front row and the back row and a front comprising the front row, and wherein the tubes form the outermost surfaces of the crash attenuator at the two sides and at the front.

9. The invention of claim 1 or 2 wherein each said row comprises an equal number of said tubes.

10. The invention of claim 1 or 2 wherein the first and second fasteners pass through respective holes in the tubes.

11. The invention of claim 1 or 2 wherein said tubes comprise a material selected from the group consisting of polymers, elastomers, and combinations thereof.

* * * * *